US007654301B2

(12) United States Patent
Krab et al.

(10) Patent No.: US 7,654,301 B2
(45) Date of Patent: Feb. 2, 2010

(54) VENETIAN BLIND

(75) Inventors: Jørn Krab, Frederiksberg (DK); Svend-Erik Dahl, Hedehusene (DK)

(73) Assignee: Joern Krab Holding ApS, Copenhagen (DK)

( * ) Notice: Subject to any disclaimer, the term of this patent is extended or adjusted under 35 U.S.C. 154(b) by 429 days.

(21) Appl. No.: 10/551,519

(22) PCT Filed: Mar. 30, 2004

(86) PCT No.: PCT/IB2004/050363

§ 371 (c)(1),
(2), (4) Date: Jun. 9, 2006

(87) PCT Pub. No.: WO2004/088085

PCT Pub. Date: Oct. 14, 2004

(65) Prior Publication Data

US 2006/0225849 A1 Oct. 12, 2006

(30) Foreign Application Priority Data

Mar. 31, 2003 (DK) ..... 2003 00485

(51) Int. Cl.
*E06B 9/30* (2006.01)

(52) U.S. Cl. ..... 160/171; 160/176.1 R; 160/178.1 R

(58) Field of Classification Search ..... 160/170, 160/171, 168.1 R, 168.1 P, 173 R, 176.1 R, 160/177 R, 178.1 R, 236, 178.3, 172
See application file for complete search history.

(56) References Cited

U.S. PATENT DOCUMENTS 2,130,318 A * 9/1938 Cruzan ..... 140/71 R (Continued)

FOREIGN PATENT DOCUMENTS

CH 308 832 8/1955

(Continued)

*Primary Examiner*—Blair M. Johnson
(74) *Attorney, Agent, or Firm*—Stites & Harbison PLLC; Douglas E. Jackson

(57) ABSTRACT

The invention relates to slats (1) for a venetian blind comprising slats of very large dimensions, both relating to the width of the slats and to the longitudinal extension of the slats (1). Thus the venetian blind comprising these slats can be made to cover very large window openings or other parts of buildings and rooms. The slats (1) are provided with longitudinal edge portions (3) serving the dual purpose of increasing the overall rigidity of the slats (1) and of providing attachment means (12) for support cords of the slats (1). The slats are operated by pairs (typically two) of lift and tilt cords running in parallel along the longitudinal edges of the slats (1), thereby avoiding passages through the slats (1), which is advantageous both from an aestetical point of view and from the point of view of the necessary production technique for the slats (1). The invention also relates to releasable attachment means (12) for connection the slats (1) to the tilt cords of the venetian blind. The Invention furthermore relates to the venetian blind as such comprising the above slats (1) and attachment means (12), and due to these is becomes possible to assemble the complete venetian blind in situ in a very easy manner. Also the removal and replacement of individual slats (1) without the necessity to dismantle major portions of the venetian blind is greatly facilitated according to the invention. Finally the invention also relates to a lift- and tilt mechanism for controlling tilting and raising/lowering of the slats (1).

19 Claims, 13 Drawing Sheets

U.S. PATENT DOCUMENTS

| | | | | | |
|---|---|---|---|---|---|
| 2,130,320 | A | * | 9/1938 | Hammer | 160/178.3 |
| 2,152,117 | A | * | 3/1939 | Wade et al. | 160/177 R |
| 2,174,249 | A | * | 9/1939 | Pratt | 160/172 R |
| 2,381,060 | A | * | 8/1945 | Kahn | 160/170 |
| 3,181,595 | A | * | 5/1965 | Pender | 160/171 |
| 3,818,969 | A | * | 6/1974 | Debs | 160/168.1 R |
| 3,916,973 | A | * | 11/1975 | Schuppler et al. | 160/178.3 |
| 4,154,281 | A | * | 5/1979 | Schluep | 160/178.3 |
| 4,155,395 | A | | 5/1979 | Frei | |
| 4,200,135 | A | * | 4/1980 | Hennequin | 160/168.1 R |
| 5,123,472 | A | * | 6/1992 | Nagashima et al. | 160/170 |

FOREIGN PATENT DOCUMENTS

| | | |
|---|---|---|
| CH | 652 168 | 10/1985 |
| DE | 38 19 920 | 12/1989 |
| FR | 2 576 964 | 8/1986 |
| GB | 1 512 274 | 5/1978 |

* cited by examiner

VENETIAN BLIND

TECHNICAL FIELD

The present invention relates to venetian blinds and more particularly to slats and corresponding fastening means of the slats and to the control means for lifting and tilting of the slats.

BACKGROUND OF THE INVENTION

The trend in many modem buildings is to use large window panels. The architectural desires lead to facades that require screens against sunlight. Most commonly conventional laminar blinds are used to provide the required shading. The size of the slats of such blinds and the maximum free span between the support cords are, however, limited. Simply scaling up the blinds and slats would lead to various kinds of stability problems. Typically in venetian blinds presently available the slats have dimensions up to about 10-cm width and a free span between the support cords of about one meter. The limited span between the support cords and the consequent high number of support cords combined with a large number of narrow slats may spoil the original aesthetic effect provided by the large glass panels. Another solution has been to limit the size of the glass panels to the dimensions of the available blinds, thus limiting the architectural freedom.

Furthermore large, unbroken window panels may lead to acoustical problems in the room bounded by these panels due to undesirable sound reflections from these panels. It would hence be desirable to have access to venetian blinds with extended length of the slats and corresponding extended span between support cords, which venetian blinds could also, for instance as an option, provide desired acoustical damping of reflections from panels covered by the venetian blinds.

Furthermore, the removal of slats for instance for replacement of these can in many prior art venetian blinds be a cumbersome process, for instance due to the lift cords being passed through passages in the individual slats and the slats being supported by the tilt cords according to the traditional ladder-cord arrangement. Such arrangements make the removal and replacement of individual slats difficult and often even impossible without dismantling major portions of the venetian blind. It would hence be desirable to provide venetian blinds of the above kind shaped and attached to tilt cords in a manner that would facilitate removal of individual slats. Furthermore, the provision of passages in the slats—either in the form of centrally located elongated slits as is often done for passage of the lift cords—or along the edge portions of the slats, for passage of attachment means for the tilt cords through each individual slat, is not optimal from a production point of view or from the point of view of cleaning of the slats. Moreover, it makes it difficult to prevent light from penetrating the slats through these passages and for instance the centrally located passages for the lift cord must necessarily be of a relative large lateral extension if the slats have to be able to undergo tilting over a major portion of the vertical tilt range from one of the slats' substantially vertical position through the horizontal position to the other substantially vertical position of the slats.

Slats for venetian blinds where the tilt cords are attached to the longitudinal edge portions of the individual slats are for instance described in GB 1 512 274 and DE 38 19 920 A1.

Thus, GB 1 512 274 discloses slats for a venetian blind comprising longitudinally extending rounded flanges through which staples are driven and secured. Supporting strings are attached to these staples outside each longitudinal edge portion of the slats. This document furthermore discloses a special tool used to facilitate driving the staples through the flanges.

DE 38 19 920 A1 discloses slats for a venetian blind where the longitudinal edge portions are formed as rounded flanges somewhat similar to those of the above document. At the appropriate locations along the longitudinal direction of the slats these flanges are provided with slots cut through the flanges and some distance into the main portion of the slat. Into these slots are inserted clips formed for pivotally engagement with corresponding spherical members attached to the supporting cords.

DISCLOSURE OF THE INVENTION

On this background, it is the object of the present invention to provide a venetian blind of the kind referred to initially, which overcomes the above-mentioned problems.

It is thus an object of the present invention to provide a venetian blind which can be used to cover large window panels comprising slats of a considerable longitudinal extension and with a large span between the support cords or tilt cords for suspending the slats and where the individual slats can furthermore easily be removed and replaced without having to remove other slats of the venetian blind and without the application of tools.

This object is achieved in accordance with independent claim 1 by providing a venetian blind that allows use of slats with dimensions that were hereto not possible. In order to Increase the usable dimensions of the slats of the venetian blind, the overall rigidity of the slats must be sufficiently high, and this is attained according to the invention by providing slats comprising an elongated main portion on either longitudinal side hereof provided with edge portions comprising a first portion and an opposing second portion forming a space therebetween, where said edge portions are furthermore provided with a gap, through which gap said space is accessible from outside. These edge portions on the one hand increases the overall rigidity of the slats and serves on the other hand as attachment means on the slats for connecting the slats to support cords or tilt cords, as will be described further in the following. The dimensions of said space are larger than the dimensions of the gap, whereby an attachment means connected to the support cords and inserted through said gap will be retained in a releasable manner within the space in the edge portions of the slats as will be described in more detail in the following.

According to an embodiment of the invention the rigidity of the slats is furthermore Increased by providing said main portion with an arched cross-sectional shape, but other cross-sectional shapes, including planar slats, are also within the scope of the present invention.

In order to further increase the overall rigidity of the slats the main portion 2 could also be corrugated or even be provided with downwardly extending ribs on the bottom surface of the main portion.

According to the invention attachment means for releasable attachment of the slats to supporting cords are inserted into the edge portions through said gap, said attachment means being also attached to the supporting cords, the releasable attachment means may be resilient in order to make it pass through a gap surrounded by substantially rigid boundaries, but it is also possible according to the invention to surround the gap by resilient boundaries for passage of substantially rigid attachment means through the gap. The attachment means according to the invention is thus formed for insertion through said gap into said space for engagement with at least some of the boundaries of said space. Some embodiments of attachment means for use with the slats according to the invention are shown and described in the detailed description of the invention, but modifications and variations of these embodiments would also be possible without departing from the scope of the invention.

The present venetian blind provides for slats with a width in excess of 200 mm, free spans between the supporting cords of up 2.5 m and more, slats with a length of at least 4 meters and a height of the blind of 6 m and more. It is understood that it is within the scope of the invention to apply more than two pairs of supporting cords if necessary in connection with very long slats, i.e. slats with a length by far exceeding the stated 4 meters.

The slats according to the invention can be made of a number of different materials. Typically the slats are made of a suitable metal, such as aluminium or steel, but other metals can also be used. Also a composite material may be used or the slats can be moulded in fibreglass etc. The prime prerequisite governing the choice of material is the necessary rigidity of the slats, but it is possible to some extend to compensate for reduced rigidity due to the choice of material by proper shaping of the slats.

It is a further object of the present invention to provide a venetian blind, which can be used to influence the acoustical characteristics of the room, in which the venetian blind is used. This object is attained according to the invention by providing at least certain portions of the slats with an acoustic damping arrangement. Thus according to an embodiment of the invention, it is possible between said edge portions of the slats to place a longitudinally extending bottom panel, preferably—although not necessarily—extending along the entire longitudinal dimension of the slat. This panel is preferably substantially planar, but other shapes could also be used, and may even prove desirable under certain circumstances. This panel can serve at least two functions. It may provide the slats with a more attractive appearance as seen from the bottom side of the slats and/or it may be utilised as an acoustic structure to improve the sound dampening characteristics of the slat. For this purpose the panel may be provided with through holes or slits providing access to the region between the panel and the main portion of the slat and this region may be provided with appropriate sound damping material in a manner known per se. In stead of a perforated panel other sound damping structures, such as a suitable fabric may also be used.

In order to obtain an aesthetically satisfactory effect it is important to suspend and operate the slats in a manner that ascertains proper alignment of all slats both in situations where the slats are stationary and during raising, lowering and tilting operations of the slats, as even minor deviations from proper alignment may subtract materially from the overall appearance of the venetian blind. As mentioned above it is furthermore desirable to be able to remove and replace individual slats easily and preferably without the application of tools. These requirement are fulfilled according to the invention by the use of a combined lift and tilt system comprising at least two pairs of tilt cords, each of the tilt cords being attached to the individual slats by means of releasable, preferably resilient clips for insertion into said edge portions of the slats. Running parallel with and preferably in close proximity to at least two pairs of said tilt cords there are provided lift cords, attached at the lower end to the lowermost slat of the venetian blind and at the upper end to a combined lift and tilt mechanism, to which mechanism also the tilt cords are connected. The extension of the lift cords in parallel with the tilt cords may be ascertained by passing the lift cords through loops formed on the tilt cords for instance at the level of each individual slat, but other means of maintaining a parallel arrangement of the lift and tilt cords may also be conceived by a skilled person, without departing from the scope of the present invention.

According to a specific embodiment of the invention, which will be described in more detail in the detailed description of the invention, two pairs of tilt cords are applied running in parallel with and in close proximity to two corresponding pairs of lift cords in the manner outlined above. According to this embodiment the points of attachment of lift- and tilt cords to the slats are located at a distance from either end of the slats substantially equal to ⅕ of the total length of the slat, thus leaving a free span between the two pairs of lift/tilt cords of substantially ⅗ of the total length of the slats. But other arrangements, comprising even more than two systems of lift- and tilt cords could also be used for instance for very long slats.

According to an alternative embodiment of the venetian blind according to the invention, vertically extending support cords or equivalent means are provided at either longitudinal end of the slats in order to increase the overall stability of the venetian blind both longitudinally and laterally, i.e. in a direction substantially perpendicular to the plane of the venetian blind. For this purpose, the slats are at either longitudinal end hereof provided with support members attached to the slats and provided with suitable passages through the member for passage of the support cords.

According to still an alternative embodiment of the venetian blind according to the invention, the lift cords are—instead of running parallel with the tilt cords—guided along the support cords, for instance through the same or additional passages in the support members as the support cords. The lift cords are also in this case attached to the lowermost slat of the venetian blind.

It is a further object of the present invention to provide a simple and yet reliable lift- and tilt mechanism which can be preferably driven by a single drive means, for instance an electrical motor, operating all pairs of lift- and tilt cords of the venetian blind. It is however understood, that separate drive means could also be used for each pair of lift- and tilt cords without departing from the invention.

According to the invention the combined lift- and tilt mechanism is positioned on a longitudinally extending shaft driven for rotation by appropriate drive means such as an electrical motor. The drive means can either be placed external of the shaft or be incorporated into a hollow portion of the shaft.

The lift- and tilt mechanism according to the invention comprises a tubular member mounted for rotation with and axial displacement over said drive shaft and guide means for maintaining the lift cords in their proper axial position and for directing the lift cords to the outer circumferential surface of said tubular member, whereby the lift cords upon rotation of said tubular member will become helically wound on or off the circumferential surface of the tubular member resulting in the slats being raised or lowered as the tubular member rotates.

According to one embodiment of the present invention said tubular member on the outer circumferential surface hereof is provided with a single thread for accommodating each of said lift cords of a given pair of lift cords in the same thread.

According to another embodiment of the present invention said tubular member on the outer circumferential surface hereof is provided with a double thread for accommodating each of said lift cords of a given pair of lift cords in separate threads hereof.

In either of the above embodiments of the lift- and tilt mechanism according to the invention the rotation of the tubular member together with the fact that the lift cords extending downwards towards the slats are restricted from axial movement in itself makes the tubular member undergo axial displacement, whereby the lift cords wind on or off the tubular member in one single, axially extending layer of cord as the tubular member rotates with the drive shaft. However, according to a third alternative embodiment of the lift- and tilt mechanism according to the invention said single/double thread provided on the outer circumferential surface of the tubular member is in engagement with a corresponding thread in a stationary bearing supporting the tubular member, this arrangement giving rise to the axial displacement of the tubular member and facilitates the proper winding on or off of the lift cords on the tubular member. In the third embodiment of the invention a gap of sufficient dimensions is formed between said thread(s) on the tubular member and on the stationary bearing for accommodation of the lift cords in said gap.

According to the invention the lift- and tilt mechanism furthermore comprises tilt means for connection to the tilt cords of a given pair of lift- and tilt cords, said bit means according to a first embodiment hereof comprising a cylindrical tilt house provided coaxially about said drive shaft and connected to this for co-rotation herewith, around the outer circumferential surface of which tilt house there is provided a tilt member following said rotation of the tilt house over a predetermined angular range due to friction between the tilt member and the tilt house. This range is determined by first means provided on the tilt member during said rotation being broad into contact with corresponding stationary abutment means. The tilt cords are wound around the tilt member, so that rotation of the tilt member in one direction makes one tilt cord of the given pair of tilt cords unwind from the tilt member and the other tilt cord of the given pair of tilt cords wind upon the tilt member. By proper dimensioning of the diameter of the tilt house and tilt member relative to the width of the slats the slats can be broad to undergo a tilting movement over an angular range of approximately 180 degrees, i.e. the slats can tilt between a substantially vertical position, where adjacent edges of the slats are in contact with each other to form one closed surface of the venetian blind through a horizontal position of the slats and to the opposite, substantially vertical position of the slats. Modifications of the ratio between the diameters of the tilt house/tilt member and the width of the slats can be used to restrict the angular tilt range, if desirable.

According to the invention the tilt member encircling the tilt house can be radially rigid, but it is also possible to provide the tilt member according to the invention with a certain degree of radial resiliency. Thus for instance a tubular tilt member could be provided with a gap radially extending through the tilt member. Radial resiliency of the tilt member has the advantageous effect that once the rotation of the tilt member relative to the tilt house, as described above, is stopped by said engagement with the abutment means continued rotation of the drive shaft and the tilt house (for lowering or raising the slats) will tend to increase the inner diameter of the tilt member due to the fact that one end of the tilt member is prevented from rotation and that a frictional force is exerted between the contact surface of the tilt member and the tilt house. Thereby the frictional force between the tilt house and the tilt member is reduced, which is advantageous from the point of view of the drive means driving the drive shaft and the tilt house. Thus by providing radial resiliency to the tilt member the drive means can use practically all of its power to raise or lower the slats without wasting power to overcome unnecessary friction between the tilt house and the tilt member. Substantial friction between the tilt house and the tilt member is thus only present, when it is needed, i.e when the tilt of the slats must be changed, in which situation rotation of the tilt member is not prevented by engagement with the stationary abutment means.

In one version of a tilt means according to the first embodiment hereof, the tilt member is a tubular member comprising a main portion and a collar defining an intermediate groove for accommodating the tilt cords.

According to a second embodiment of the tilt mechanism according to the invention, the tilt mechanism is formed as a separate mechanism remote from the lift mechanism.

Generally, there exists a relationship between the width of the slats and the diameter of the tilt house and tilt member necessary for tilting the slats from a first vertical orientation through a horizontal orientation to an opposite vertical orientation of the slats. Thus, wide slats—for instance of a width of 20 to 25 cm—require a correspondingly large diameter of the tilt house and tilt member. It can, however, be desirable to be able to apply tilt mechanisms where the diameter of the tilt house and tilt member are limited even though slats of a considerable width are applied in the venetian blind. This problem is solved according to the invention by means of a specially advantageous embodiment of the tilt mechanism employing a double-stop function, according to which abutment means provided on the tilt member during rotation of the tilt member are not brought into engagement with stationary abutment means but with another rotational abutment means, whereby rotation of the tilt member around the tilt house can take place over an angle of more than 360 degrees around the tilt house. Eventually, the rotational abutment means will be brought to rest by abutment with a stationary abutment means provided for instance on the bearing supporting the tilt mechanism. By these means, rotation of the tilt member between 0 degrees and approximately 720 degrees around the tilt house can take place. It is even possible to extend this mechanism by providing a consecutive series of rotational abutment means, whereby the tilt member will be able to undergo a rotation around the tilt house of approximately N*360 degrees, where N is the number of such rotational abutment means +1, the number 1 accounting for the original tilt member. A specific embodiment of this alternative tilt mechanism is described in detail in the detailed description of the invention.

In order to prevent light from penetrating through the contact regions along the longitudinal edges of the slats portions of the regions of the edges of the slats can be provided with sealing material, such as felt, rubber etc.

A number of advantageous effects are attained by the venetian blind system according to the invention. Thus the attachment of the slats along the longitudinal edges hereof is highly advantageous from an aesthetical point of view due to the omission of passages cut through the main portion of the slats, as it is typically done in most known venetian blind systems for passage of a lift cord. The absence of passages through the main portion of the slats is also advantageous from the point of view of controlling of passage of light through the venetian blind. In venetian blinds comprising very large slats as is typically the case in connection with the venetian blind according to the invention comparatively large passages would have to be provided through the slats for the passage of a lift cord, and such passages would have to extend over a substantial portion of the width of the slats in order to make it possible to tilt the slats to their two substantially vertical positions. Thus even if corresponding edge portions of adjacent slats were brought into tight contact with each other—in order to prevent light from penetrating the venetian blind—light would still penetrate said comparatively large passages in the slats. A complete darkening of the room would hence not be possible with slats comprising said passages, but can be attained with the venetian blind according to the invention. If necessary sealing material, such as rubber, felt etc. can even be provided at the edge portions of the slats to prevent light from penetrating between adjacent slats.

Also from the point of view of cleaning the slats it is advantageous to have large, unbroken surfaces of the slats without cords penetrating the slats.

Furthermore, as mentioned initially, the presence of the longitudinal edge portions along either edge of the slats increases the overall rigidity of the slats thus providing for venetian blinds of great longitudinal extension, typically with the application of only two pairs of lift- and tilt cords. It is thus possible to cover large surfaces, not necessarily only window openings, with a single venetian blind, having large extensions both horizontally and vertically.

The attachment of the tilt cords along the edge portions makes both initial assembling of the venetian blind easy and also facilitates removal and replacement of single slats without the necessity to dismantle major parts of the whole venetian blind. The easy initial assembling of even venetian blinds of considerable dimensions furthermore opens up for the possibility to purchase the venetian blind in the form of a kit to be easily assembled in situ. The slats can for instance be kept in stock in form of very long slats, which can be sold in the lengths actually needed. The ease of assembling the venetian blind in situ is also advantageous from a transportation point of view.

Also from a production point of view the unbroken surface of the slats together with the fact that the slats can be made in one piece for instance with the aid of a roll forming technique is highly advantageous.

Finally the slats may be used for altering the acoustical characteristics of a room by the provision of the various forms of acoustic damping arrangements on the slats. The tilting of the slats can even be utilised to alter the acoustical effect of the slats, it being possible to obtain either an acoustical hard surface, when the slats are in one of their vertical positions, or various degrees of acoustical damping, when the slats are tilted.

BRIEF DESCRIPTION OF THE DRAWINGS

The invention will now be described in more detail with reference to the accompanying drawings, in which.

DETAILED DESCRIPTION OF THE INVENTION

In the following a detailed description of a presently preferred embodiment of the invention is given.

Figure 1:
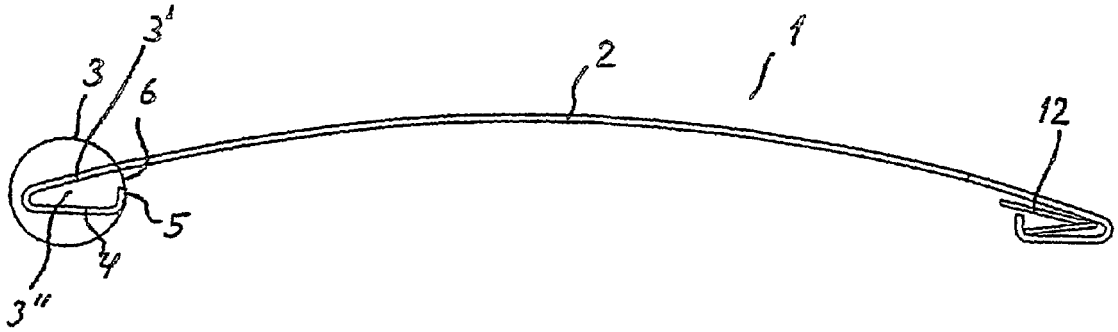
FIG. 1 is a cross-sectional view of one slat according to the invention.

With reference to FIG. 1 there is shown a cross sectional view of one slat according to the invention generally designated by 1. The slat comprises a longitudinally extending main portion 2, which according to this embodiment is upwardly arched, although other cross sectional shapes may also be conceived. The slat comprises front and rear longitudinal edge portions 3 comprising first portions 3' in the following referred to as top portions, and is furthermore provided with inwardly extending second portions 4—in the following referred to as bottom portions 4, which in the shown embodiment are substantially planar. These bottom portions 4 terminates in attachment portions 5 directed towards the bottom surface of the main portion 2 of the slat. Between the attachment portions 5 and the bottom surface of the slat there is formed a gap 6 for insertion of appropriate attachment means 12 into the space formed between the top portion 3', the bottom portion 4 and the attachment portion 5.

The slat according to this embodiment may be produced in a simple manner by known techniques, such as roll forming.

Figure 2:
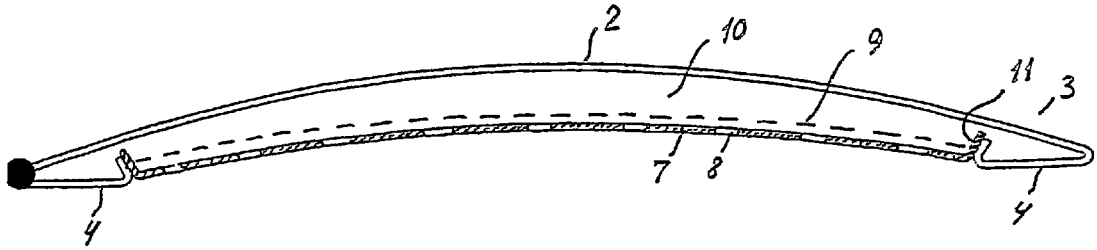
FIG. 2 is a cross-sectional view of the slat shown in FIG. 3 provided with a sound damping panel on the bottom portion of the slat.

With reference to FIG. 2 there is shown an optional embodiment of the slat 1 according to the invention, where the slat 1 has been provided with a bottom panel 7, which may be substantially planar as shown in FIG. 2, but which could also have other cross-sectional shapes. The panel may comprise one single unbroken surface, and for instance be provided for purely decorative purposes or it may be formed as a sound damping element in a manner known per se for instance by the provision of a suitable pattern of passages 8 through the panel. These passages can for instance be circular or have the form of elongated slits, although many other shapes would also be possible. Along the longitudinal edges of the panels 7 the panels are provided with attachment portions 11 for releasable attachment to the slats 1 for instance along the attachment portions 5 or via the gaps 6 herein. For optimal sound damping characteristics the bottom panels 7 may furthermore be provided with a sound damping fabric 9 covering said passages 8. Furthermore the internal volume 10 formed between the bottom panel 7 and the bottom surface of the main portion 2 of the slat 1 may be provided with appropriate acoustic damping material. It would also be possible solely to apply a fabric instead of the panel, and provide this fabric with suitable attachment means along the edges hereof.

A number of attachment means could be envisaged for the slats according to the present invention. The prime prerequisite for these attachment means is their ability to pass through the gap between the first and second edge portions of the slat and to be retained within the space between these portions after passage through the gap.

Figure 3A:
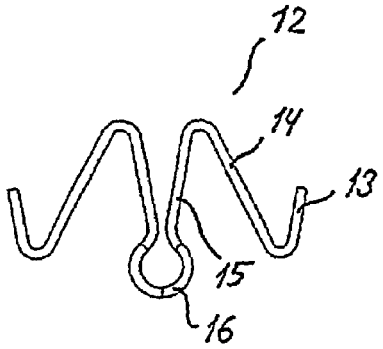
FIGS. 3*a* and 3*b* are a view of a clip used for attachment of the slats to the tilt cords.
Figure 3B:
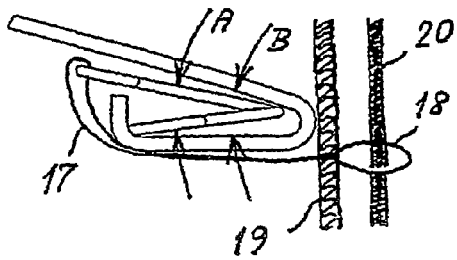

With reference to FIGS. 3*a* and 3*b* there is shown an embodiment of attachment means 12 for use with the slats 2 according to the invention, where it is assumed, that the edge portions 3 are substantially rigid, i.e. the gap 6 is bounded by substantially rigid boundaries between 5 and 3'. The attachment means according to this embodiment consists of a clips of metal wire or other suitable material formed in a symmetrical manner about a central loop portion 16 and furthermore comprising a first leg portion 15 substantially in the plane of the central loop portion 16 and second and third leg portions 14, 13 in a plane forming an angle A relative to the plane of the central loop portion 16 and the first leg portion 15. The angle A is chosen in accordance with the corresponding angle B between the first and second edge portions 3' and 4 of the slat 2 in such a manner that the attachment means 12 becomes retained within the space 3" of the edge portion 3 after insertion through the gap 6. Through the loop portion 16 a cord 17 connects the slat 2 to the tilt cord 19, thereby suspending the slat 2 from the tilt cord 19. Opposite the cord 17 there is provided at loop 18, through which the lift cord 20 passes, whereby the lift cords 20 will run substantially parallel with the tilt cords 19.

Figure 4A:
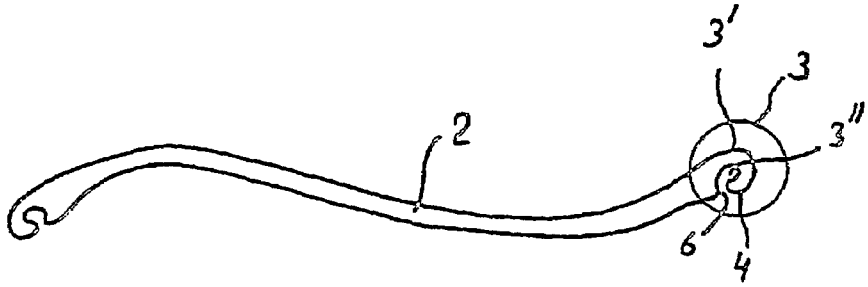
FIGS. 4*a* and 4*b* are cross-sectional views of two alternative slats according to the invention.
Figure 4B:
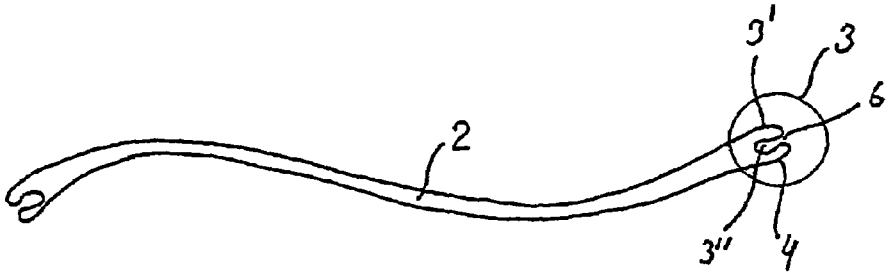

With reference to FIGS. 4*a* and 4*b* there are shown schematical representations of slats of other cross-sectional shapes according to the present invention. Numerous other shapes would of course also fall within the scope of the invention as defined by the appended claims.

Figure 4C:
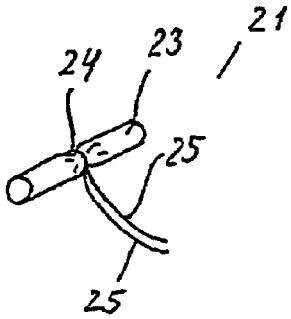
FIGS. 4*c* and 4*d* are alternative attachment means for the slats shown in FIGS. 4*a* and 4*b;*
Figure 4D:
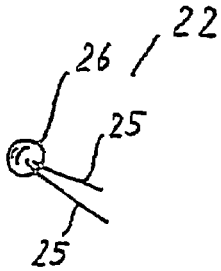

The attachment means shown in FIGS. 3*a* and 3*b* can not be used in connection with the edge portions 3 shown in FIGS. 4*a* and 4*b*. A couple of alternative embodiments of attachment means for use with the edge portions in FIGS. 4*a* and 4*b* are shown in FIGS. 4*c* and 4*d*. The attachment means shown in FIG. 4*c* comprises a cylindrical rod 23 made from a material of sufficient resiliency to allow it to pass through the gap 6 shown in FIGS. 4*a* and 4*b* and provided with a circumferential groove 24 for fastening the cord 25 connected to the tilt cord 19. Alternatively the cord 25 could also be embedded in the cylindrical rod 23 for instance during moulding hereof or passed through a passage provided in the cylindrical rod 23. As an alternative to the cylindrical rod 23 a resilient sphere 26 as shown in FIG. 4*d* could also be used. It is understood that the above attachment means could alternatively be made of a rigid material if the edge portions 3 are resilient as described above.

Figure 5:
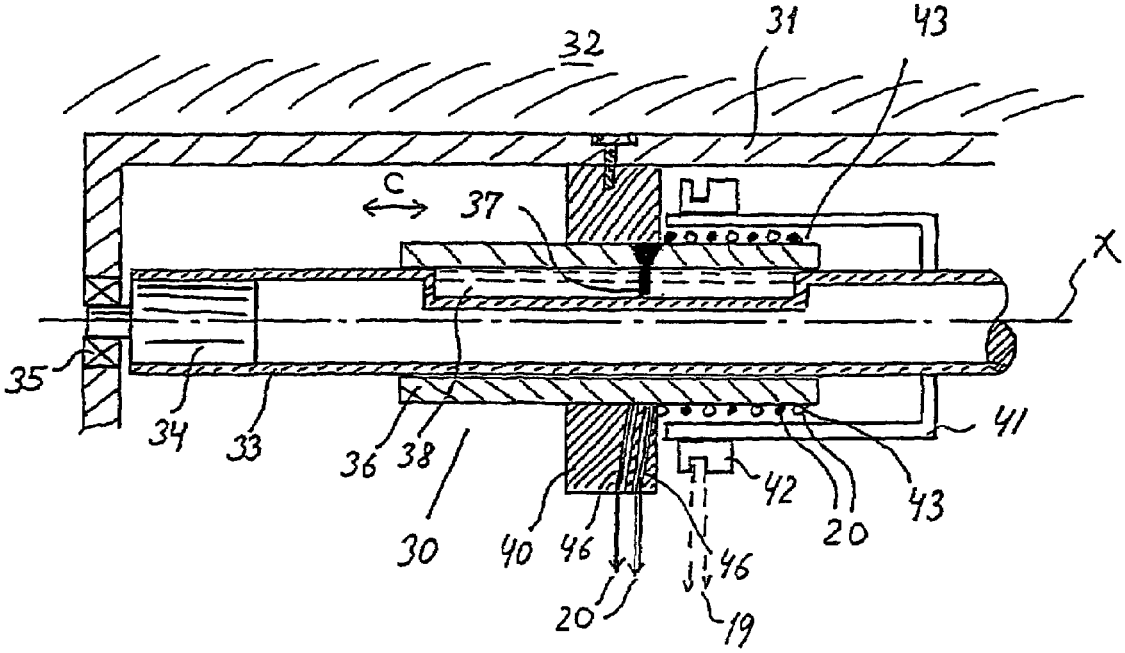
FIG. 5 is a view of a first embodiment of a combined lift- and tilt mechanism (lift- and tilt mechanism) according to the invention.

With reference to FIG. 5 there is now shown a schematic representation of a first embodiment of a lift- and tilt mechanism 30 for use in the venetian blind according to the invention for controlling a single pair of lift- and tilt cords. This mechanism is attached to a housing 31 mounted for instance in the upper portion of a window opening or in the ceiling. The main components of the venetian blind according to the invention comprise a longitudinally extending shaft 33, which can be common for a number—typically two—of lift- and tilt mechanisms, although separate shafts 33 for each of a plurality of lift- and tilt mechanisms could also be envisaged, each being provided with suitable drive means, such as a motor designated by reference numeral 34. In the first of these cases synchronisation of the lift- and tilt mechanisms are ascertained through application of a common drive shaft but in the latter case means for synchronisation of the different lift- and tilt mechanisms may be necessary. According to the embodiment shown in FIG. 5 at least a part of the shaft 33 is hollow for accommodation of the motor 34 within the shaft, but other arrangements of motors and drive means connecting the shaft 33 and the drive shaft bearing 35 of the motor 34 could also be used without constituting a departure from the lift- and tilt mechanism according to the present invention. In the embodiment shown the drive shaft bearing 35 of the motor is attached to the abovementioned housing 31.

Figure 6:
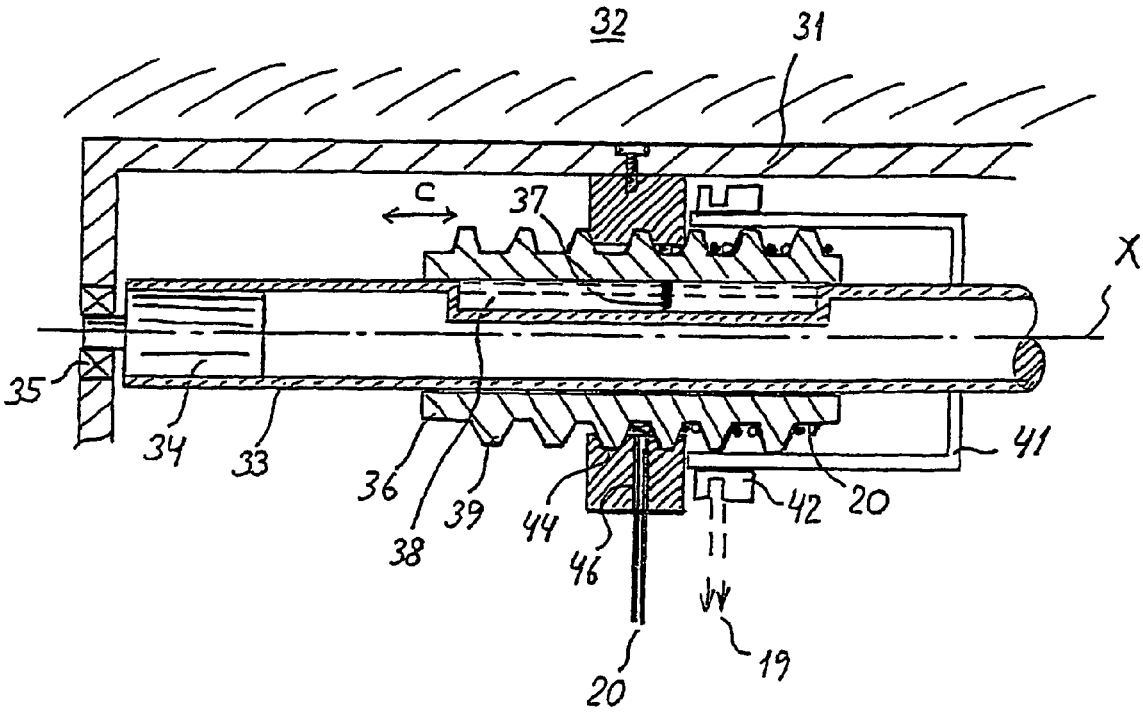
FIG. 6 is a view of a second embodiment of a combined lift- and tilt mechanism (lift- and tilt mechanism) according to the invention.

Around the shaft 33 there is provided a tubular member 36 dimensioned for rotation with the shaft 33 and for axial displacement over a predetermined longitudinal distance of the shaft 33, this displacement being indicated by the arrow C in FIGS. 5 and 6. The combined rotation with the shaft 33 and simultaneous displacement hereon is obtained according to this embodiment of the lift- and tilt mechanism by engagement between an engagement means 37 extending radially inward from the tubular member 36 and into engagement with a longitudinal channel 38 provided in the shaft 33. The tubular member 36 is mounted for rotation relative to the housing 31 by means of an appropriate bearing 40, which is only shown schematically in FIGS. 5 and 6.

As shown in FIG. 5 a pair of lift cords 20 for raising or lowering of the slats 2 are wound helically around the tubular member 36. In order to maintain the lift cords 20 on their proper longitudinal position during rotation of the shaft 33 and the tubular member 36 the lift cords 20 are in the embodiment shown directed through channels 46 provided in the bearing 40, but it is understood that other arrangements for maintaining the longitudinal position of the lift cords 20 could also be used without departing from the lift- and tilt mechanism according to the invention. The ends 43 of the lift cords are fixed to the tubular member 36. The winding of the lift cords 20 onto and off the tubular member 36 takes place in a double helical manner as indicated in the figures, where one lift cord is shown in black and the other in an open representation. When the shaft 33 and the tubular member 36 rotates, controlled by the motor 34, the longitudinal retainment of the lift cords 20 in their downward direction towards the slats 2 forces the tubular member to undergo longitudinal displacement relative to the shaft, whereby the lift cords 20 are wound on of off the tubular member 36 according to the direction of rotation hereof.

A second embodiment of the lift- and tilt mechanism according to the invention is shown in FIG. 6. According to this embodiment the tubular member 36 is on the circumferential surface hereof provided with threads 39 for engagement with corresponding threads 44 in the stationary bearing 40. According to this embodiment the longitudinal displacement of the tubular member 36 on the shaft 33 is attained by the engagement between the thread 39 on the tubular member 36 and the thread 44 in the stationary bearing 40. The thread on the tubular member 36 furthermore serves the purpose of ascertaining a reliable winding on and off of the lift cords 20 on the tubular member, as the thread is formed to accommodate the two lift cords 20 of a given pair of lift cords within a single groove of the thread. The thread according to this embodiment is thus a single thread formed to accommodate two cords in side by side relation in the single groove of the thread.

According to a third embodiment of the lift- and tilt mechanism according to the invention (not shown) the single thread comprised in the second embodiment is replaced by a double thread, each thread accommodating one of the lift cords 20 of the given pair of lift cords.

According to a preferred version of the above second and third embodiments of the lift- and tilt mechanism according to the invention the inner circumferential surface of a cylindrical tilt house 41, which will be described in the following, substantially touches the crests of the thread 39 on the tubular member 36, whereby substantially closed spaces for accommodating the lift cords 20 are formed between the tubular member 36 and the inner circumferential surface of the cylindrical tilt house 41, thus preventing the lift cords 20 from becoming entangled or leaving contact with the tubular member 36 during operation of the mechanism.

In order to be able to accommodate the lift cords 20 in the region between the tubular member 36 and the stationary bearing 40 a sufficient space must of cause be provided between the corresponding threads as depicted in FIG. 6, A preferable choice of thread has proved to be a trapezoidal thread, although other shapes could also be used.

Figure 7A:
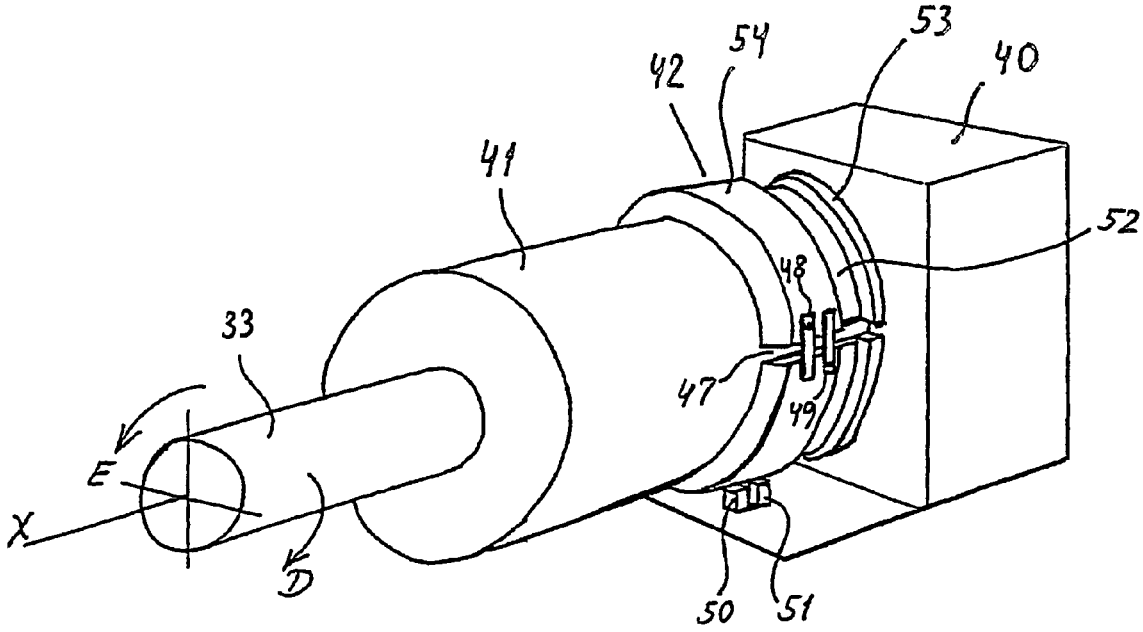
FIG. 7*a* is a schematic perspective view of the tilt mechanism according to the invention.
Figure 7B:
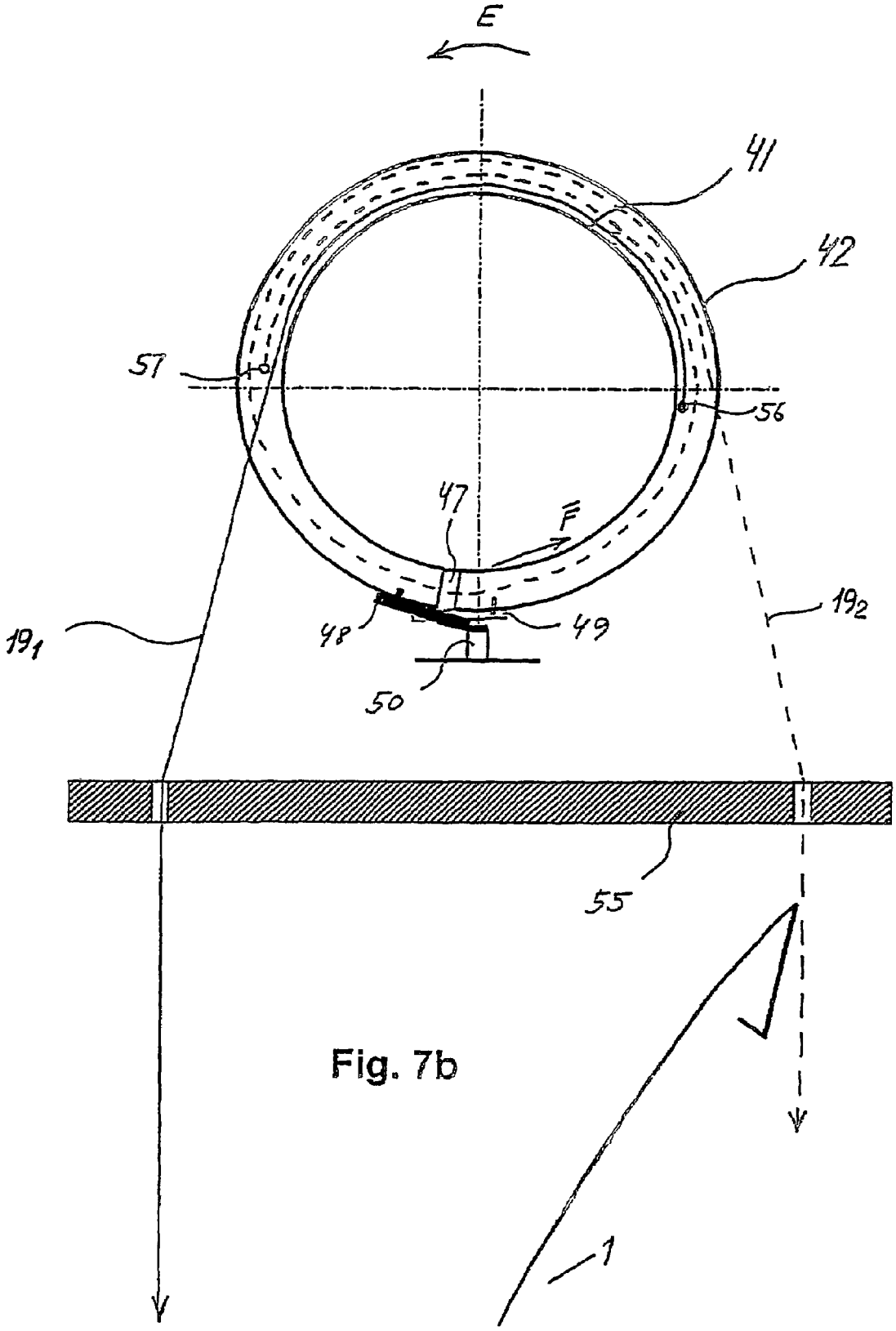
FIG. 7*b* is a schematic view of the tilt mechanism according to the invention as seen from one longitudinal end of the tilt mechanism.

With reference to FIGS. 7*a* and 7*b* there is now shown a tilt mechanism according to one embodiment of the present invention. Thus referring to FIG. 7*a* said tilt mechanism comprises a cylindrical tilt house 41 provided coaxially about and connected to said drive shaft 33 for co-rotation herewith, around the outer circumferential surface of which tilt house 41 there is provided a circular, radially resilient tilt member 42. The tilt member 42 may comprise an axially extending gap 47 to allow the tilt member 42 to expand radially, although this is not a necessary prerequisite for the function of the tilt mechanism. The diameter of the tilt member 42 is chosen such that a frictional force is exerted between the tilt member and the tilt house 41, whereby a rotation of the tilt house 41 will cause the tilt member 42 to undergo rotation simultaneously with the tilt house 41 and the drive shaft 33. The rotation of the tilt member 42 in the direction of the arrow D will however be prevented, when a tongue 48 provided in the vicinity of the gap 47 makes contacts with a stationary abutment 50. Similarly, for a rotation in the opposite direction, as indicated by the arrow E, rotation of the tilt member 42 will be prevented, when a tongue 49 makes contact with a stationary abutment 51.

Referring to FIG. 7*b* there is shown a schematic representation of details of the tilt mechanism according to the invention. The tilt cords 191 and 192 of the venetian blind are attached to substantially diametrically opposite points 56 and 57 respectively on the tilt member 42 and wound around the tilt member (accommodated in a groove 52 provided in the tilt member between a main portion 54 hereof and a collar 53, although this is not apparent from FIG. 7*b*). Thus a rotation of the tilt member 42, which according to this embodiment of the tilt mechanism takes place over an angular range of approximately 360 degrees, corresponding either to contact between the tongue 48 and the abutment 50 or to contact between the tongue 49 and the abutment 51 (hidden behind the abutment 50 in FIG. 7*b*) makes one of the tilt cords 191 move for instance in a downward direction and the other tilt cord 192 move in an upward direction. The slats 2 attached to the tilt cords thus undergo a tilting movement. By proper choice of the ratio between the diameter of the tilt house 41 and the width of the slats 2 it is thus possible to make the slats 2 tilt between a first, substantially vertical position I and the opposite, also substantially vertical position II as shown in FIG. 7*b*. The angular tilt range of the slats 2 can be changed either by changing the diameter of the tilt house 41 or by changing the positions of the abutments 50, 51, thereby preventing the tilt member 42 from undergoing substantially a full 360 degrees rotation.

In the state shown in FIG. 7*b* the tilt house 41 rotates counterclockwise as indicated by the arrow E, whereby the tongue 48 has been brought into contact with the abutment 50. The tilt member 42 is thus prevented from further counterclockwise rotation. The frictional force F between the tilt house 41 and the tilt member 42 will hereafter tend to increase the width of the gap 47 in the tilt member 42, thus increasing the diameter hereof and hence reducing the frictional force between the tilt house and the tilt member as previously described. By a subsequent clockwise rotation of the tilt house 41 the tilt member 42 becomes free to rotate with the tilt house 41 until engagement between the other tongue 49 and the corresponding abutment 51 is established. By a further clockwise rotation of the tilt house 41 the diameter of tilt member 42 will again tend to increase, thereby reducing the frictional force between the tilt house 41 and the tilt member 42.

In the state shown in FIG. 7*b* the tilt cord $\mathbf{19}_1$ has been wound maximally off the tilt member 42, thus leaving approximately ½ turn of cord on the circumference of the tilt member 42. The other tilt cord $\mathbf{19}_2$ is wound maximally on the tilt member 42 corresponding to approximately 1½ turn of cord.

Figure 8:
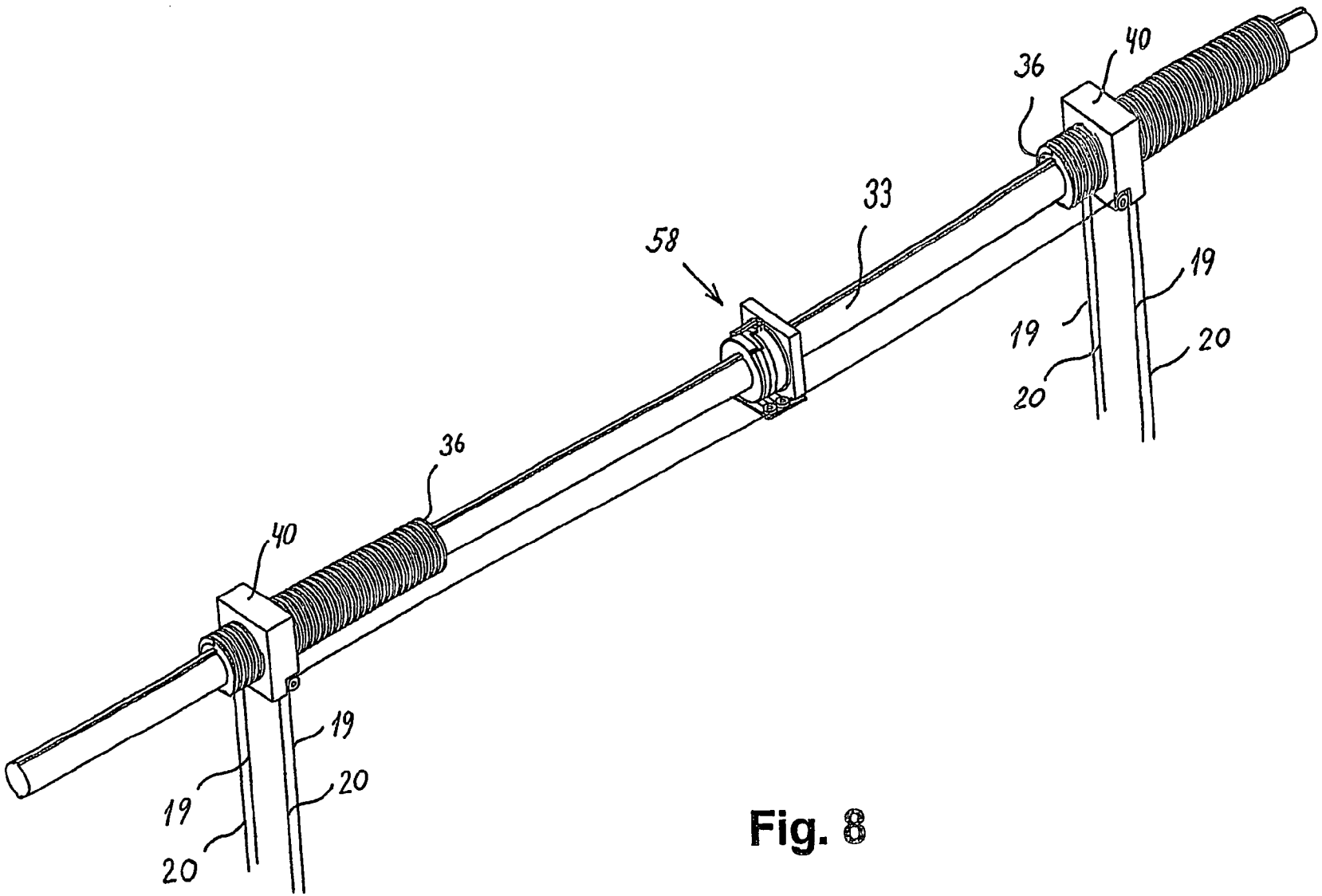
FIG. 8 is a schematic perspective view of a second embodiment of the lift- and tilt mechanism according to the invention comprising two separate lift mechanisms and a single, separate tilt mechanism as shown in FIG. 9.

An alternative embodiment of the lift- and tilt mechanism according to the invention is shown in FIG. 8. According to this embodiment, the lift- and tilt mechanisms are provided on the drive shaft 33 in the form of separate mechanisms remote from each other. According to FIG. 8 the tilt mechanism 58 is furthermore designed to operate both pairs of tilt cords 19, although it would also be possible to provide tilt mechanisms for each of the pairs of tilt cords as described previously. The lift mechanisms shown in FIG. 8 are of the embodiment comprising threads to accommodate the lift cords, either of the single-thread or double-thread type as described previously, although a mechanism without threads could also in principle be used. Furthermore, other housings (not shown) for closing the open region(s) of the threads and for protecting the tubular member and the lift cords wound around this may be provided as previously discussed.

The drive shaft is in FIG. 8 driven by a suitable motor. This could be inserted in the drive shaft, the drive shaft being for this purpose split up into two sections, but it is understood that other means of driving the shaft 33 may also be employed, as for instance a motor housed within a hollow portion of the drive shaft as previously described.

Figure 9:
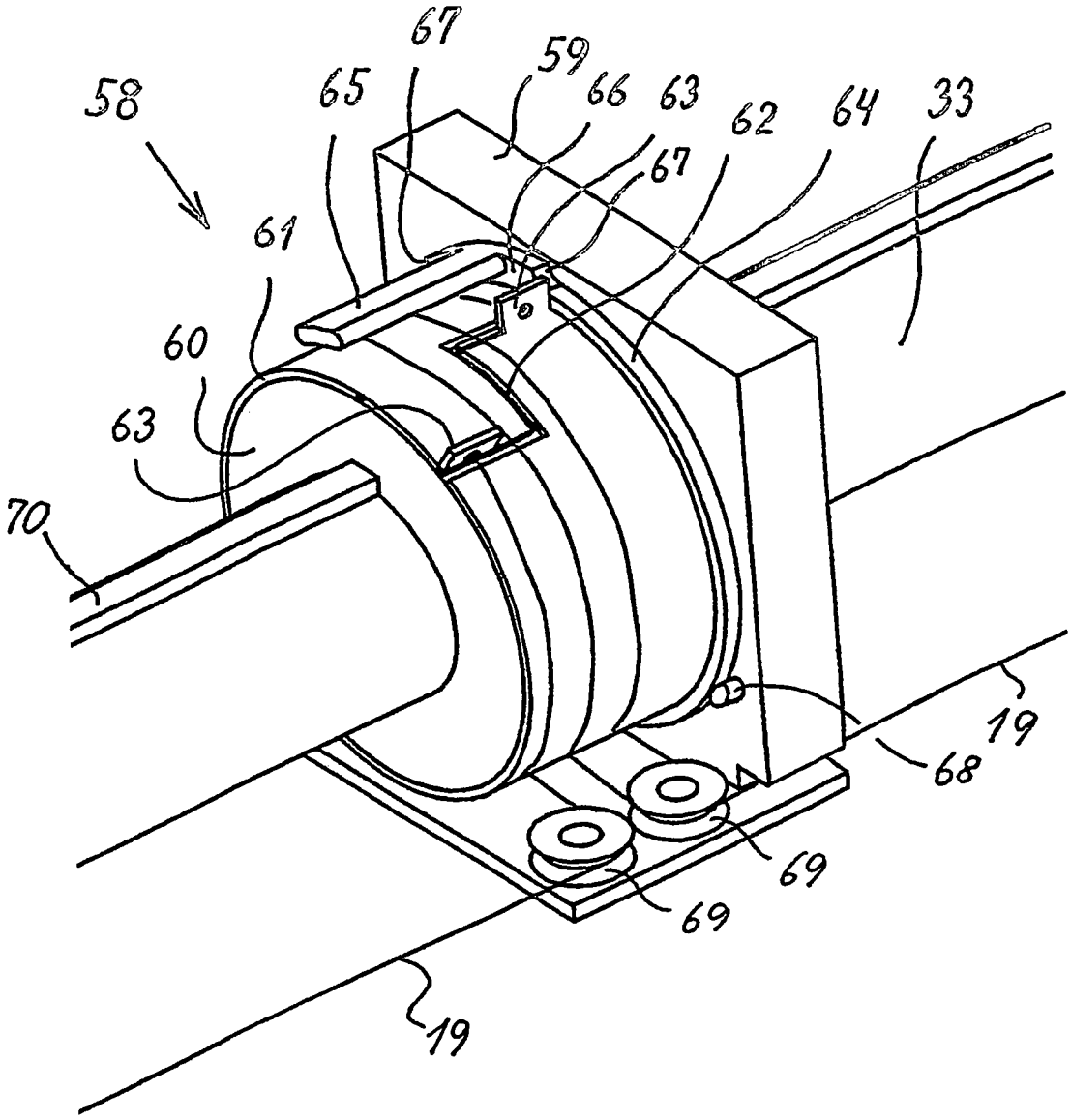
FIG. 9 is a schematic perspective view of a second embodiment of a tilt mechanism according to the invention with double-stop function for reducing the necessary diameter of the tilt mechanism.

Referring now to FIG. 9, there is shown the alternative embodiment of the tilt mechanism 58 according to the invention provided with the double-stop function mentioned previously. The tilt mechanism is supported by a stationary bearing 59 and comprises a tilt drum 60 mounted for rotation with the drive shaft 33, for instance by means of a suitable slot and key arrangement 70. Around the tilt drum is provided a tilt member 61 cut up longitudinally by a slit 62 for facilitating radial expansion/compression of the tilt member. Two abutment means 63 are provided proximate to said slit, i.e. at either circumferential end of the tilt member. In the embodiment of a tilt mechanism previously described, these abutment means would have been brought into engagement with a stationary abutment means for instance provided on the stationary bearing, but according to the embodiment shown in FIG. 9 engagement takes place between either of these abutment means 63 and a tongue 65 provided on a rotatable abutment ring 64, rotating around the tilt drum 60. When either of the first abutment means 63 during rotation of the tilt member 61 is brought into engagement with the tongue 65, rotation of the tilt member 61 continues until an end face 67 provided on either end of an abutment portion 66 on the rotational abutment ring is brought into engagement with a stationary abutment means 68 provided at a suitable place on the stationary bearing 59.

Tilt cords 19 are directed from the slats via suitable systems of pulleys (for instance 69) and wound around the tilt member in a manner corresponding for instance to that shown previously in connection with the first embodiment of tilt mechanism. Such tilt cords are indicated in FIG. 9, but the manner in which they are actually wound around the tilt member can be subject to variations, which would be obvious to a person skilled in the art. In FIG. 9, they are attached to the first abutment means 63, but attachment of the tilt cords to the tilt member could take place at other circumferential positions as well. Finally, only one of the tilt cords of each pair of tilt cords is shown in FIG. 9, but the corresponding tilt cords are also connected to the tilt member, in the figure hidden from view by the tilt mechanism and the drive shaft 33.

The range of rotation of the rotatable abutment ring 64—and hence of the tilt member 61 around the tilt drum 60—is determined by the circumferential extent of the abutment portion 66. Hence, by proper choice of the circumferential extent of the abutment portion, the desired rotation range can be set.

Figure 10A:
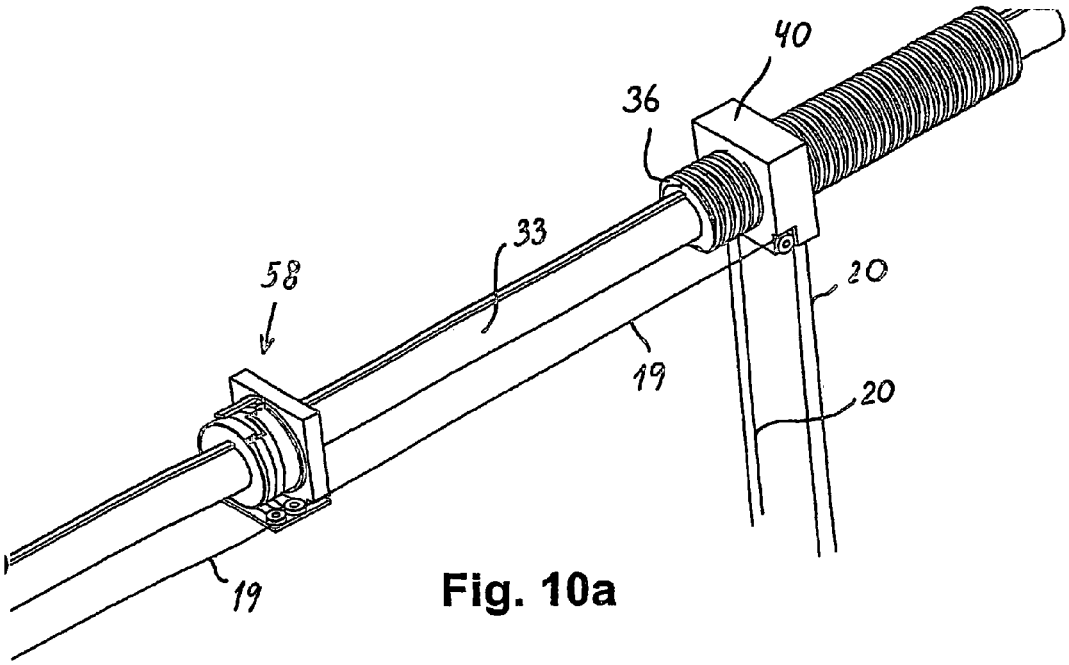
FIGS. 10*a*, 10*b* and 10*c* are schematic representations of alternative routings of lift cords to the tubular member of the lift mechanism.
Figure 10B:
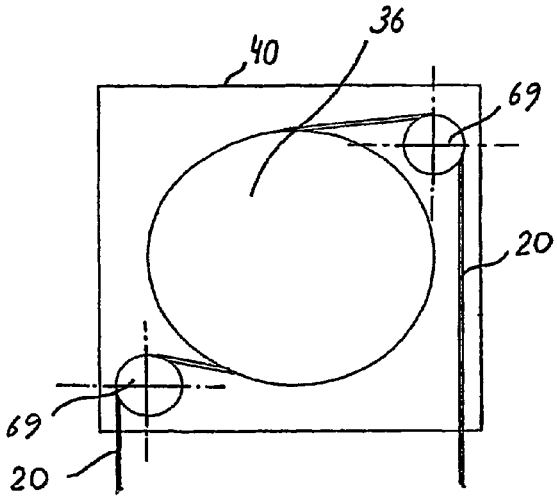
Figure 10C:
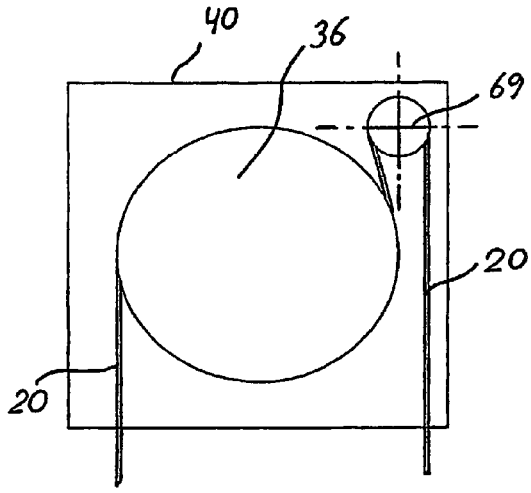

With reference to FIGS. 10*a*, 10*b* and 10*c*, there are shown schematic representations of alternative routings of lift cords 20 to the tubular member 36 of the lift mechanism shown in FIG. 10*a*. Thus, FIG. 10*b* shows a first alternative comprising two pulleys 69 and FIG. 10*c* shows a second alternative comprising only a single pulley 69. In either alternative, the pulleys are located within the stationary bearing 40 and suitable openings and/or channels for the lift cords are provided in the stationary bearing. Other routing mechanisms for the lift cords may also be envisaged by a person skilled in the art.

Figure 11:
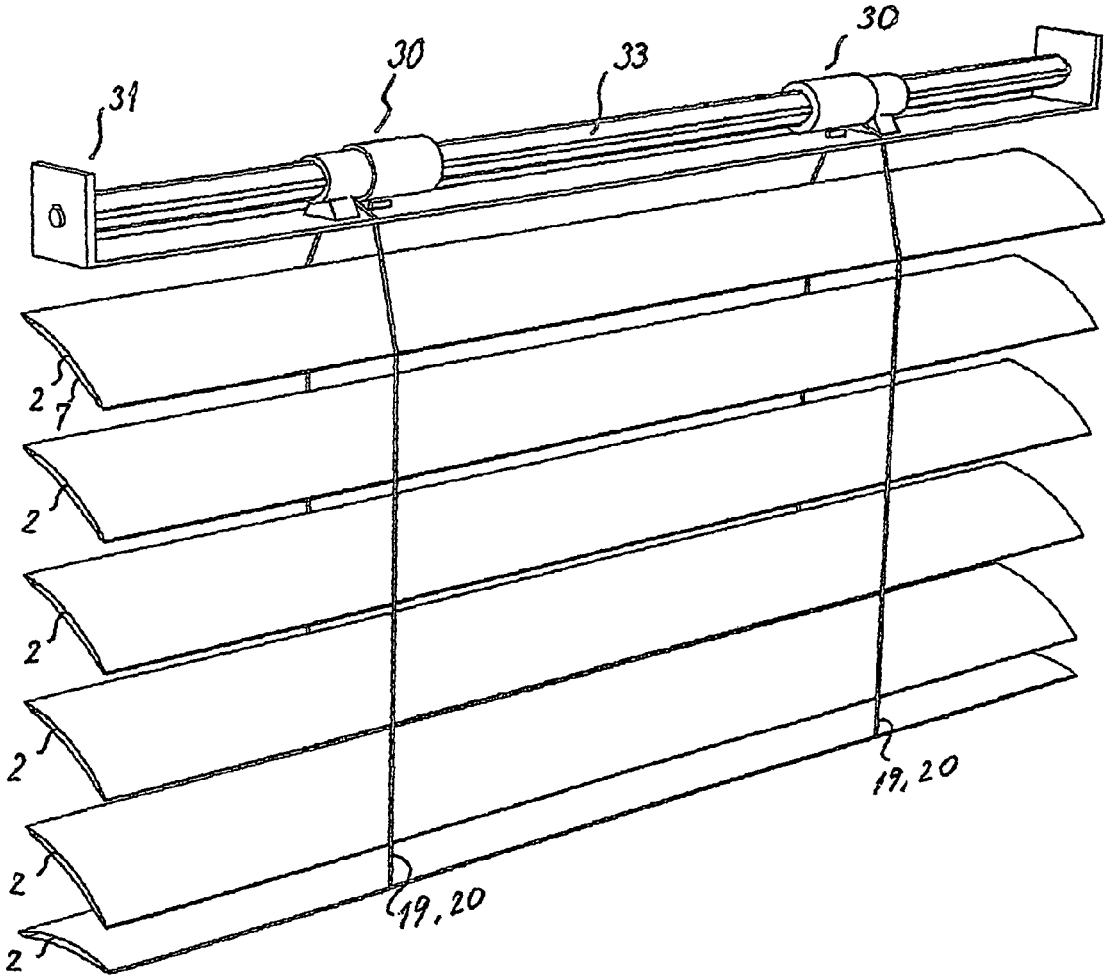
FIG. 11 is a schematical representation of the venetian blind according to the invention showing only the main components hereof as viewed from the side.

With reference to FIG. 11 there is shown an overview of an embodiment of a venetian blind according to the invention comprising the slats 2, attachment means 12 and lift- and tilt mechanism 30 according to one embodiment of the invention as described in detail above.

The slats can as an option be provided with resilient bands in contact regions between adjacent slats in order to prevent light from penetrating the contact regions between the slats. Also such resilient bands would prevent the generation of noise when adjacent slats are broad into contact with each other during operation of the venetian blind.

Figure 12A:
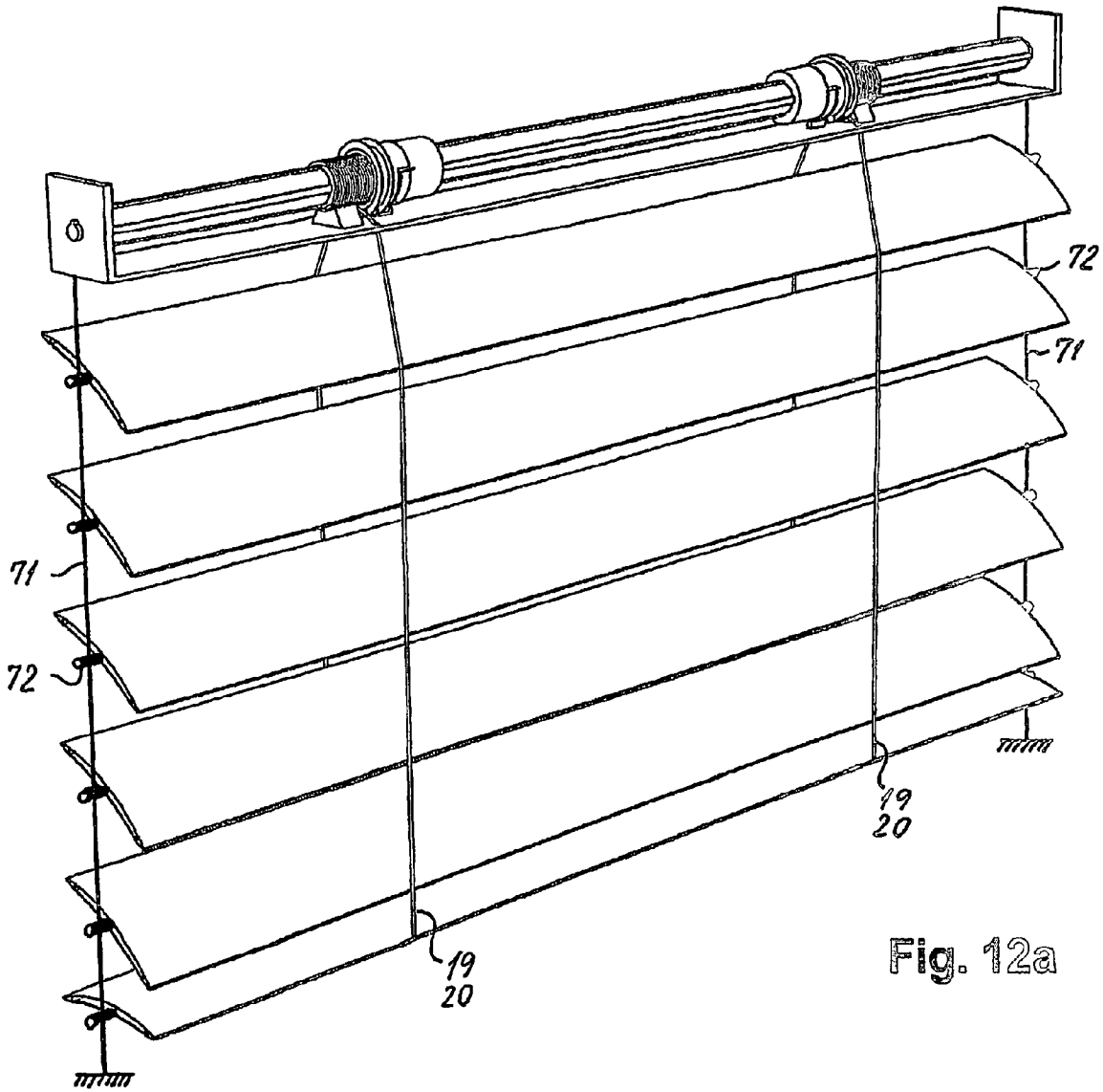
FIG. 12*a* is a schematic representation of a venetian blind according to an alternative embodiment of the invention comprising lateral support cords to enhance stability of the venetian blind in the longitudinal direction of the slats.
Figure 12B:
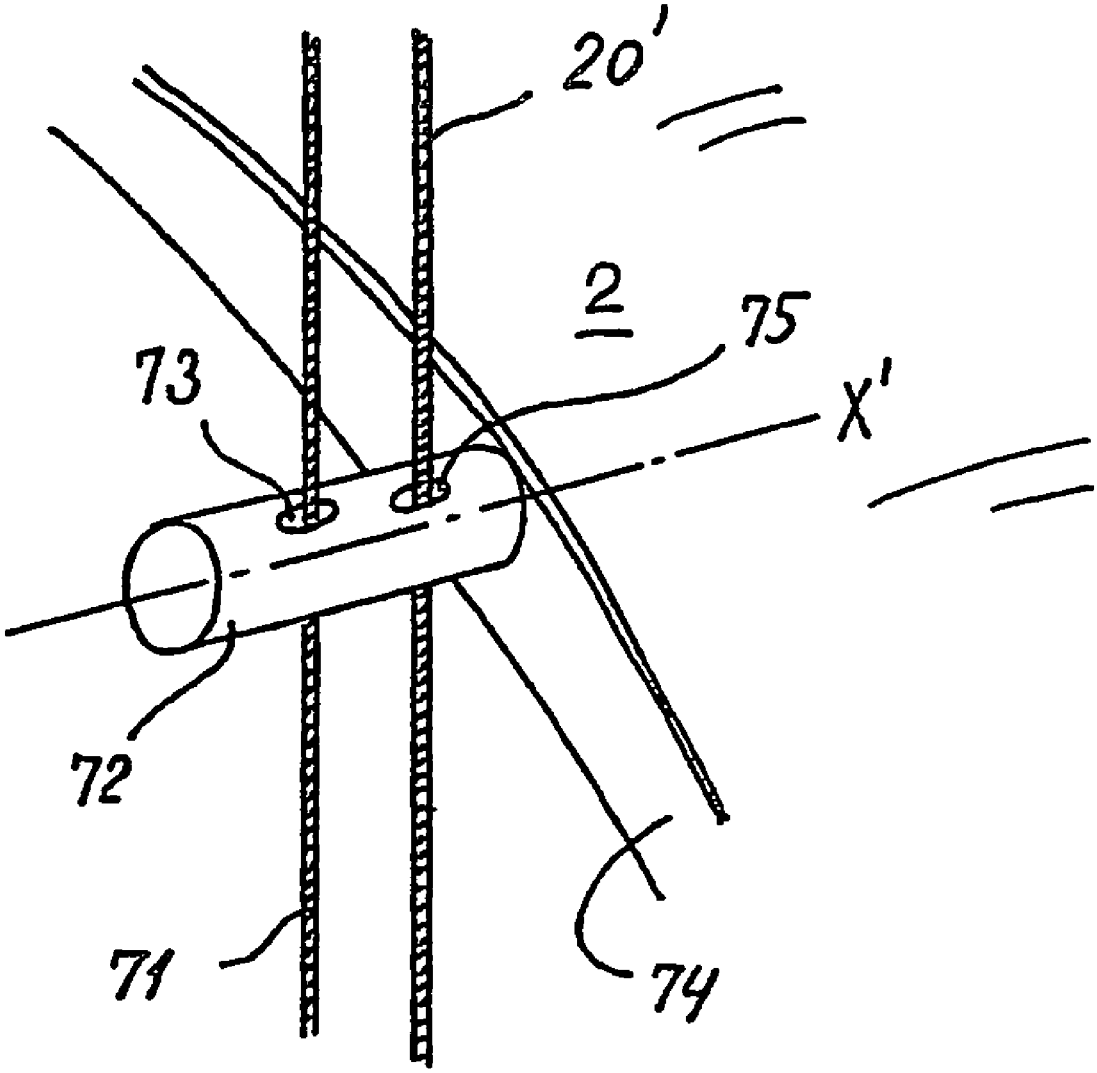
FIG. 12*b* is a schematic representation of a detail of the venetian blind shown in FIG. 12*a*.

With reference to FIGS. 12*a* and 12*b* there is shown an alternative embodiment of the venetian blind according to the invention, where vertically extending support cords 71 are provided at either longitudinal end of the slats 2 in order to increase overall stability of the venetian blind. Although referred to as support cords, it is understood that other means for instance substantially rigid rods of suitable dimensions could also be used. The support cords 71 pass through a passage 73 provided in a support member 72 attached to the longitudinal end of the slat, and for this purpose the end of the slat can be provided with an end cap or member 74 formed for instance for insertion into the hollow structure of the slat. In order not to interfere with the tilting of the slats, the support member 72 is mounted for rotation about the axis X' through the member, i.e. for rotation relative to the slat.

The provision of the support members 72 or equivalent members at the longitudinal ends of the slats leads to a further alternative embodiment of the venetian blind according to the invention. As shown in FIG. 12*a*, only support cords 71 are provided at the longitudinal ends of the slats, whereas both the tilt cords and the lift cords 19, 20 are positioned relative to the slats as described previously. It is, however, also possible to provide the lift cords at either longitudinal ends of the slats, by for instance passing lift cord 20' through second passages 75 in the support members 72 and attaching the lift cords 20' to the lowermost slat. By this alternative embodiment, one of the main objectives of the invention—the omission of passages for the lift cords penetrating the slats—is also attained.

Although various embodiments of the present invention have been shown and described in the preceding parts of the detailed description, it is understood that a person skilled in the art may conceive other embodiments of the invention without departing from the scope of the invention as defined by the following claims.

REFERENCE NUMERALS

1. Slat
2. Main portion of slat
3. Longitudinal edge portions of slat
4. Bottom portions of slat
5. Attachment portions of slat
6. Gap
7. Bottom panel
8. Passages
9. Fabric
10. Internal volume
11. Attachment portions of bottom panel
12. Attachment means
13. Third leg portion
14. Second leg portion
15. First leg portion
16. Central loop portion
17. Attachment cord
18. Loop
19. Tilt cord
20. Lift cord
21. Attachment means
22. Attachment means
23. Cylindrical rod
24. Circumferential groove
25. Cord
26. Sphere
30. Lift- and tilt mechanism
31. Headrail
32. Ceiling
33. Shaft
34. Motor
35. Attachment of motor drive shaft to headrail
36. Tubular member
37. Engagement means of tubular member
38. Longitudinal channel
39. Thread on tubular member
40. Stationary bearing
41. Cylindrical tilt house
42. Tilt member
43. Ends of lift cords
44. Thread in stationary bearing
45. Gap between threads
46. Channels through stationary bearing for lift cords
47. Gap in tilt member
48. Tongue attached on one side of gap in tilt member
49. Tongue attached on the other side of gap in tilt member
50. Abutment
51. Abutment
52. Circumferential groove in tilt member
53. Circumferential collar of tilt member
54. Main portion of tilt member
55. Bottom portion of headrail
56. Attachment point for tilt cord

57. Attachment point for tilt cord
58. Tilt mechanism (second embodiment)
59. Stationary bearing of tilt mechanism
60. Tilt drum
61. Tilt member
62. Slit
63. Abutment means
64. Rotatable abutment ring
65. Abutment tongue
66. Abutment portion
67. End face of abutment portion
68. Stationary abutment
69. Pulley
70. Key
71. Support cord
72. Support member
73. Passage
74. End cap
75. Passage

The invention claimed is:

1. A venetian blind for covering large window panels comprising:

a plurality of parallel elongated slats, each said slat having front and rear longitudinally extending edge portions connected by a main portion, where each of said edge portions comprises a first portion extending laterally relative to the main portion and an opposing second portion forming a space therebetween, said edge portions being furthermore provided with a gap, through which said gap said space is accessible from outside, a width of said gap being less than a maximum distance between said first and second portions, and an attachment member for each said front and rear edge portions, each said attachment member being formed for insertion through said gap into said space for engagement with the boundaries of said space such that the attachment member does not penetrate the slat, and each said attachment member comprising a central loop portion a) connected to a first leg portion lying substantially in a plane of the central loop portion and b) connected to second and third leg portions lying in a plane forming an angle relative to the plane of the central loop portion and the first leg portion;

at least two pairs of tilt cords for releasable attachment to said front and rear edge portions of the slats by use of said attachment members in the slats;

at least two pairs of lift cords running substantially parallel with said tilt cords and attached to the lowermost of said slats;

a lift mechanism including at least one tubular member mounted for rotation always with and axial displacement over a drive shaft, at least one associated guide for maintaining the lift cords in a proper axial position and for directing the lift cords to an outer circumferential surface of said tubular member, whereby the lift cords upon rotation of said tubular member are helically wound on or off the circumferential surface of the tubular member resulting in the slats being raised or lowered as the tubular member rotates; and a tilt mechanism including at least one cylindrical tilt house provided coaxially about the drive shaft for co-rotation always therewith the helically wound portion of the lift cord being located between the tubular member and the tilt house, at least one tilt member provided around the outer circumferential surface of the tilt house and following the rotation of the tilt house due to friction between the tilt member and the tilt house, a stop provided on the tilt member which limits the rotation of the tilt member over a predetermined angular range by being brought into contact with corresponding stationary abutments, whereby said tilt cords are wound around said tilt member so that rotation of the tilt member in one direction makes one tilt cord of a given pair of tilt cords unwind from the tilt member and the other tilt cord of the given pair of tilt cords wind upon the tilt member.

2. A venetian blind according to claim 1, further including:

a lift mechanism for each of said pairs of lift cords; and a tilt mechanism for each of said pairs of tilt cords.

3. A venetian blind according to claim 2, wherein said lift mechanism and said tilt mechanism are provided on a common drive shaft driven for rotation by a common drive.

4. A venetian blind according to claim 2, wherein said tubular member on the outer circumferential surface thereof is provided with a single thread for accommodating each of said lift cords of a given pair of lift cords in the same thread.

5. A venetian blind according to claim 2, wherein (a) said tubular member on the outer circumferential surface thereof is provided with a thread for accommodating each of said lift cords of a given pair of lift cords in the same thread, and (b) said thread being in engagement with a corresponding thread in a stationary bearing supporting the tubular member.

6. A venetian blind according to claim 5, wherein said thread is trapezoidal.

7. A venetian blind according to claim 6, wherein a gap is formed between said thread on the tubular member and on the stationary bearing for accommodation of the lift cords therein.

8. A venetian blind according to claim 2, wherein said tilt member is radially resilient.

9. A venetian blind according to claim 8, wherein said tilt member is provided with an axially extending gap.

10. A venetian blind according to claim 2, wherein said tilt member is a tubular member comprising a main portion and a collar defining an intermediate groove for accommodating the tilt cords.

11. A venetian blind according to claim 3, wherein said common drive is a motor fixedly accommodated within said common drive shaft.

12. A venetian blind according to claim 3, wherein said cylindrical tilt house is a tilt drum, wherein said stop is a first abutment provided on the tilt member, and wherein said stationary abutments are an abutment tongue provided on a rotatable abutment ring such that a further rotation of the tilt drum will result in the rotatable abutment ring rotating around the tilt drum until further rotation is prevented by engagement of a portion of the rotatable abutment ring with a non-rotatable abutment.

13. A venetian blind according to claim 12, wherein said tilt member is radially resilient.

14. A venetian blind according to claim 12, wherein said tilt member is provided with an axially extending slit.

15. A venetian blind according to claim 12, wherein a portion of the rotatable abutment ring is provided with circumferentially spaced end faces such that the circumferential extension of said portion is used to set the rotation range of the tilt member around the tilt drum.

16. A venetian blind according to claim 8, wherein the ends of the each of the tilt cords are attached to the tilt member at points lying substantially diametrically opposite each other on the tilt member and that the tilt cords are wound in opposite directions on the tilt member.

17. A venetian blind according to claim 12, wherein the ends of each of the tilt cords are attached to the tilt member at points lying substantially diametrically opposite each other on the tilt member and that the tilt cords are wound in opposite directions on the tilt member.

18. A venetian blind according to claim 1, wherein support cords are provided at each longitudinal end of the slats for engagement with the slats, whereby the stability of the venetian blind is increased.

19. A venetian blind according to claim 18, wherein the lift cords run parallel with said support cords and pass through passages in support members provided at the longitudinal ends of the slats.

* * * * *

UNITED STATES PATENT AND TRADEMARK OFFICE

CERTIFICATE OF CORRECTION

PATENT NO. : 7,654,301 B2
APPLICATION NO. : 10/551519
DATED : February 2, 2010
INVENTOR(S) : Krab et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 847 days.

Signed and Sealed this

Twenty-third Day of November, 2010

David J. Kappos

David J. Kappos
*Director of the United States Patent and Trademark Office*